US006279214B1

(12) United States Patent
Kassuelke et al.

(10) Patent No.: US 6,279,214 B1
(45) Date of Patent: Aug. 28, 2001

(54) MOISTURE SEAL FOR COMPOSITE SABOT WITH DEPLETED URANIUM PENETRATOR

(75) Inventors: Gregory T. Kassuelke, Maple Grove; Robert E. Long, Minnetonka; Stephen J. Price, Chanhasson, all of MN (US)

(73) Assignee: Alliant Techsystems Inc., Hopkins, MN (US)

( * ) Notice: Subject to any disclaimer, the term of this patent is extended or adjusted under 35 U.S.C. 154(b) by 0 days.

(21) Appl. No.: 09/353,695

(22) Filed: Jul. 14, 1999

(Under 37 CFR 1.47)

(51) Int. Cl.[7] ..... F42B 33/00; F42B 14/06

(52) U.S. Cl. ..... 29/1.2; 102/511; 102/521; 86/19

(58) Field of Search ..... 102/511, 520–523; 29/1.2–1.23; 86/19

(56) References Cited

U.S. PATENT DOCUMENTS

| | | | | |
|---|---|---|---|---|
| H265 | * | 5/1987 | Bonde et al. | 102/521 |
| H401 | * | 1/1988 | Ibach | 89/1.2 |
| 3,948,184 | | 4/1976 | Pierre et al. . | |
| 3,952,657 | | 4/1976 | Kaltmann . | |
| 4,736,666 | | 4/1988 | Hillebrenner et al. . | |
| 5,063,854 | | 11/1991 | Bisping et al. . | |
| 5,121,692 | * | 6/1992 | DiCarlo | 102/522 |
| 5,189,254 | * | 2/1993 | Berville et al. | 102/521 |
| 5,227,580 | * | 7/1993 | Berville et al. | 102/521 |
| 5,359,938 | * | 11/1994 | Campoli et al. | 102/521 |
| 5,635,660 | | 6/1997 | McGovern | 86/21 |
| 5,640,054 | | 6/1997 | McGovern | 264/3.1 |
| 5,747,725 | | 5/1998 | Stewart et al. | 102/521 |
| 5,789,699 | | 8/1998 | Stewart et al. | 102/521 |
| 5,794,320 | | 8/1998 | Wernz et al. . | |
| 6,090,756 | * | 7/2000 | Brown | 102/511 |
| 6,125,764 | * | 10/2000 | Kamdar | 102/521 |

FOREIGN PATENT DOCUMENTS

| | | |
|---|---|---|
| 545 956 A | 2/1974 | (CH) . |
| 40 41 716 A | 6/1992 | (DE) . |
| 0 455 550 A | 11/1991 | (EP) . |
| 0 989 382 | 3/2000 | (EP) . |
| 1 222 737 | 2/1971 | (GB) . |

OTHER PUBLICATIONS

HumiSeal Division Chase Corporation, HumiSeal 2A53 Epoxy coating Application and Material Safety Data Sheets, Dec. 30, 1997.

* cited by examiner

*Primary Examiner*—Harold J. Tudor
(74) *Attorney, Agent, or Firm*—George A. Leone, Sr.

(57) ABSTRACT

Coating composite material sabot parts for reducing depleted uranium corrosion and sealing the surface of a machined composite sabot commences with cleaning the composite material sabot parts. Rinsing the composite material sabot parts, drying the machined composite sabot, and wiping the composite material sabot parts with a solvent follows cleaning. A moisture resistant insulator film is applied on the composite material sabot parts. Excess material is abrasively removed and additional coats are applied. The parts are wiped with a solvent between coats.

10 Claims, 4 Drawing Sheets

MOISTURE SEAL FOR COMPOSITE SABOT WITH DEPLETED URANIUM PENETRATOR

FIELD OF THE INVENTION

The present invention is generally related to applying a coating of moisture resistant insulator film on composite sabots with depleted uranium penetrators. More particularly, the moisture resistant insulator films are what are known as conformal coatings, such as, acrylic, urethane, polyurethane, pentaglycidalether of cyclosilicon (Siloxirane™), epoxy paint or two-part epoxy synthetic resins.

BACKGROUND OF THE INVENTION

In general, a sabot is a lightweight carrier for a projectile, or kinetic penetrator. Use of a sabot permits the firing of a variety of projectiles of a smaller caliber within a larger caliber weapon. A sabot fills the bore of the gun tube while encasing the projectile to permit uniform and smooth firing of the weapon. The projectile is centrally located within the sabot that is generally radially symmetrical. After firing, the sabot and projectile clear the bore of the gun tube and the sabot is normally discarded some distance from the gun tube while the projectile continues toward the target.

Advanced saboted kinetic energy tank ammunition is constructed using composite material for the sabot and depleted uranium for the penetrator. Unfortunately, depleted uranium corrodes readily when in contact with moisture or humid environments and graphite based composite materials. Moisture is not only a problem for the depleted uranium but the composite material sabot parts as well.

Sabots constructed from composite material are machined using conventional methods. Machining typically exposes raw fiber ends and surface micro-cracking in the outer and inner geometry of the sabot. Moisture wicks along the fiber paths. Further, the resin matrix of the composite material absorbs moisture. Moisture thus wicked or absorbed causes the composite part to increase in size and lose some of its mechanical properties. The resultant corrosion and composite part degradation may cause handling hazards, failures in chambering rounds, and other performance failures.

Prior solutions for the corrosion problem described above have focused on placement of a sealing bead of silicone material between the three segments of molded composite parts which comprise the sabot. This was done to prevent moisture from propagating down the flanks of the segments, which provide an unobstructed path for moisture directly to the penetrator. Unfortunately, silicone beading has proven substantially ineffective for preventing corrosion of a depleted uranium penetrator.

One theory that is believed to explain the cause of corrosion of the depleted uranium is that composite materials and depleted uranium, when assembled in the presence of water, form a cell that accelerates the corrosion of the depleted uranium. In order to break up the cell, either the anode (depleted uranium), cathode (graphite) or electrolyte (water) must be removed from the reaction. In one embodiment, the present invention breaks up the cell by adding a nonconductive barrier coating on the sabot, thereby removing the conductive composite material from contributing to the cell.

SUMMARY OF THE INVENTION

The present invention provides a method for coating composite material sabot parts for reducing sabot moisture absorption, reducing depleted uranium corrosion and for sealing the surface of the composite material sabot parts. The process steps commence with cleaning the composite material sabot parts. Cleaning is followed by rinsing the composite material sabot parts, drying the machined composite sabot, and wiping the composite material sabot parts with a solvent. A moisture resistant insulator film is applied on the composite material sabot parts.

In a preferred embodiment, excess material is abrasively removed and additional coats are applied. The parts are wiped with a solvent between coats.

Other objects, features and advantages of the present invention will become apparent to those skilled in the art through the description of the preferred embodiment, claims and drawings wherein like numerals refer to like elements.

DETAILED DESCRIPTION OF THE INVENTION

Figure 1:
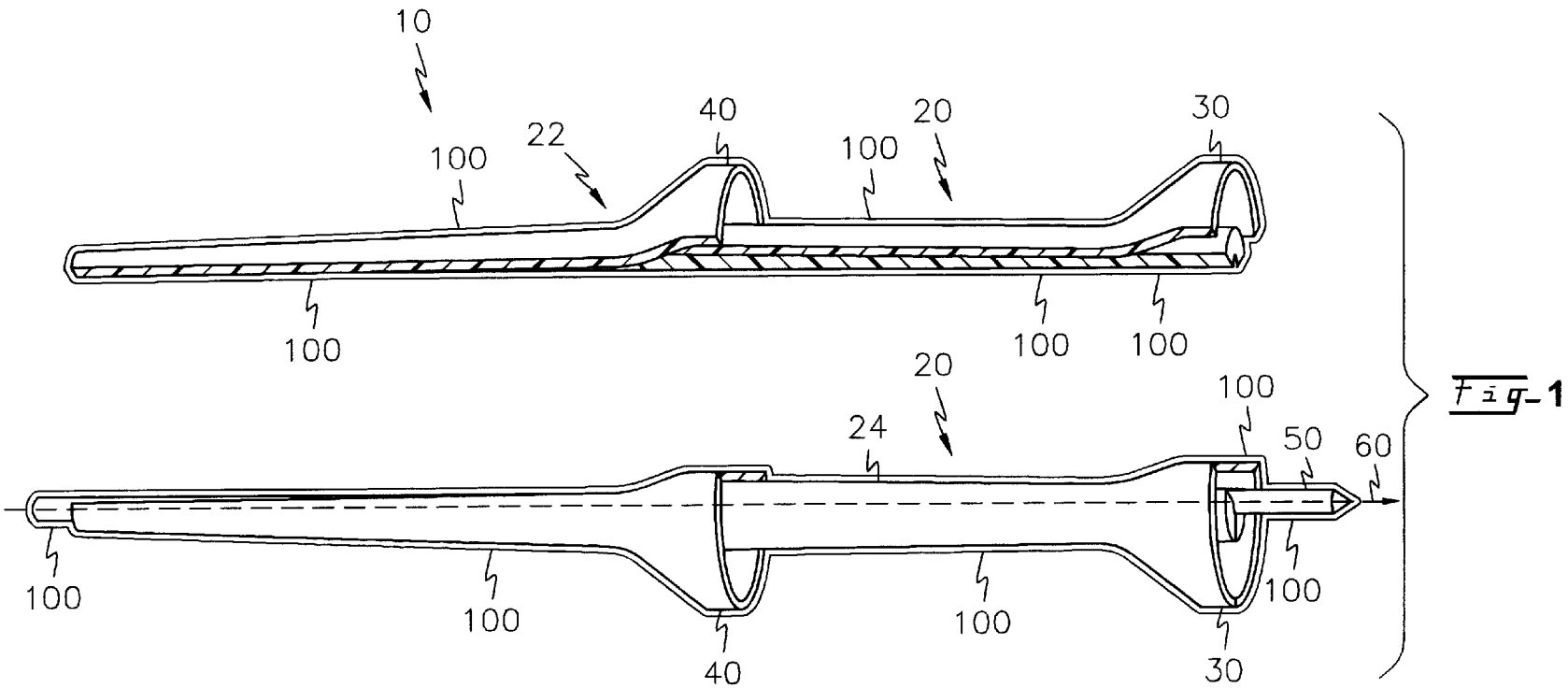
FIG. 1 is an exploded three-dimensional perspective view of a projectile with a composite sabot.

Illustrated in FIG. 1 is an exploded three-dimensional perspective view of one example of a composite sabot assembly 10 constructed in accordance with the present invention. Composite sabot assembly 10 has a sabot body 20, a front scoop 30, and a rear bourrelet 40. Composite sabot assembly 10 is axially divided along three petal divisions 24 into three sabot petals 22. Sabot petals 22 are radially mounted around a penetrator 50 and a sabot axial direction 60.

The sabot petals 22 are molded parts constructed from a plurality of composite material kit parts. The sabot petals 22 are machined for shaping and removing irregularities before assembly into the composite sabot assembly 10. In accordance with a preferred method of the invention, each of the components of the composite sabot is coated with a moisture resistant insulator film 100. Coating is most preferably done after machining and before assembly of the various components to form the composite sabot assembly.

Figure 2:
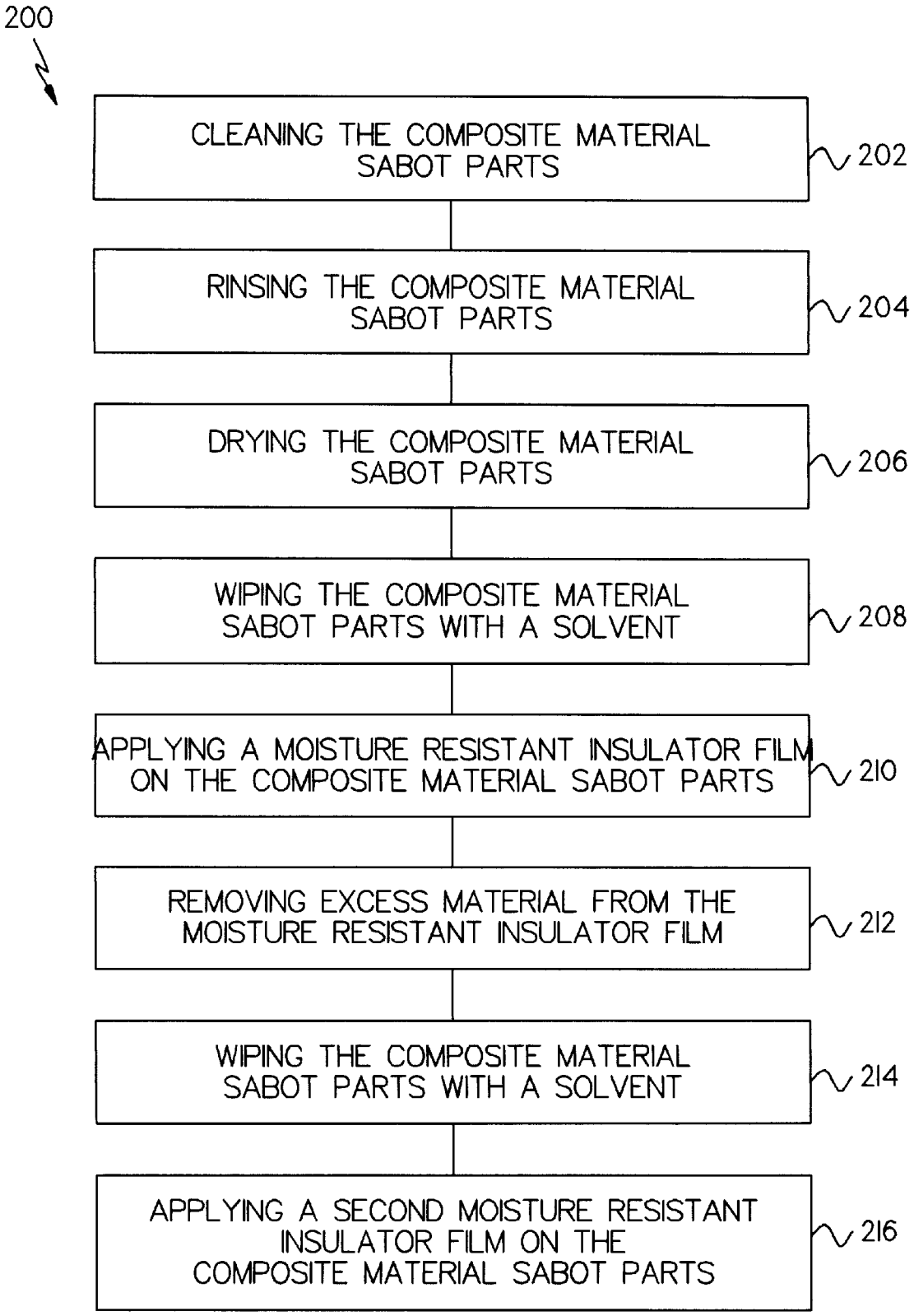
FIG. 2 shows a flow chart for one example of a method of the invention for seal coating a sabot against moisture.

Referring now to FIG. 2, a flow chart for one example of a method of the invention for seal coating a sabot against moisture is shown. In one embodiment of the invention, the process 200 adds a coating to composite material sabot parts for reducing depleted uranium moisture absorption and sealing the surface of the composite material sabot parts. The process 200 commences at step 202, cleaning the composite material sabot parts. In a preferred embodiment, the step of cleaning the composite material sabot parts includes placing the composite material sabot molded and machined parts into a heated ultrasonic cleaner with soap following conventional cleaning methods. Cleaning may alternately be done ultrasonically using liquid trichloroethane followed by degreasing in trichloroethane vapors.

Cleaning is followed at step 204 with rinsing the composite material sabot parts, step 204, drying the composite material sabot parts, step 206, and wiping the composite material sabot parts with a solvent, step 208. Appropriate solvents include isopropyl alcohol, acetone and the like. A moisture resistant insulator film is applied and cured on the composite material sabot parts at step 210.

In a preferred embodiment of the invention, the step of drying comprises air drying. In addition, in a preferred embodiment, after applying the moisture resistant film, excess material is removed from the moisture resistant insulator film at step 212. After removing the excess material, the composite is again wiped with a solvent at step 214. In a more preferred embodiment, a second coat of moisture resistant insulator film is applied to the parts at step 216 and cured. The process may be repeated as desired for multiple coats. It will be understood that after each application the resin is cured to manufacturer's specifications that may include room or elevated temperatures.

Figure 4:
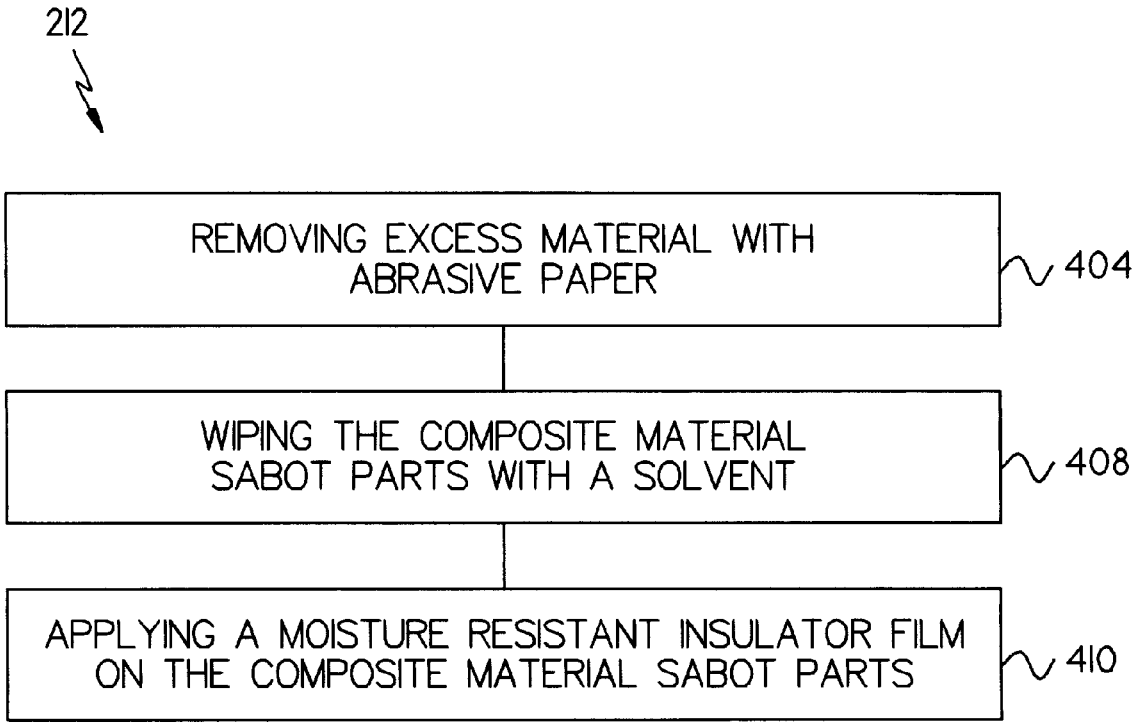
FIG. 4 illustrates a flow chart for one example of a method of the invention for the step of removing excess material from composite parts.

Referring now to FIG. 4, a flow chart for one example of a method of the invention for the step of removing excess material 212 is shown. Step 212 includes the sub-steps of removing excess material with abrasive paper, step 404, wiping the composite material sabot parts with a solvent, step 408, applying at least one additional coat of moisture resistant insulator film and curing the coat according to the film manufacturer's specifications, step 410. The moisture resistant insulator film may be sprayed on or brushed onto the parts. Alternatively, the parts may be dipped into the moisture resistant film material. Useful moisture resistant film materials include acrylic, urethane, polyurethane, pentaglycidalether of cyclosilicon, epoxy paint or two-part epoxy synthetic resins. Epoxy paint may be obtained from Diamond Vogel Paints, Orange City, Iowa.

In one example of a method of the invention, the composite parts are sprayed with Humiseal # 2A53, a two component epoxy. Humiseal # 2A53 is available from the Chase Corporation, Woodside, N.Y. 11377 and is manufactured with the following materials and properties. The first component of the two part epoxy is the conformal coating that is manufactured including the ingredients and properties listed in Table 1.

TABLE 1

| MATERIAL | WEIGHT % |
|---|---|
| Toluene | 18–21 |
| Methyl Isobutyl Ketone | 12–15 |
| Section 3B | |
| Epoxy Resin | 60–70 |
| Optical Brightener | <.1 |
| BOILING POINT: 231 F. | |
| VAPOR PRESSURE (mm Hg): 22 | |
| VAPOR DENSITY (AIR = 1): 4.0 | |
| SPECIFIC GRAVITY (H2O = 1): 1.07. | |
| PERCENT VOLATILE BY VOLUME (%): 46–51. | |
| EVAPORATION RATE (BUAC = 1): 2.85. | |
| SOLUBILITY IN WATER: Negligible - less than 0.1 percent. | |
| APPEARANCE AND ODOR: Water clear, low viscosity liquid, aromatic odor. | |

The second component of the two part epoxy is the epoxy hardener that is manufactured including the ingredients and properties listed in Table 2.

TABLE 2

| MATERIAL | WEIGHT % |
|---|---|
| Xylene | 40–43 |
| Ethyl Benzene | 3–5 |
| Butyl Alcohol | 8–11 |

TABLE 2-continued

| MATERIAL | WEIGHT % |
|---|---|
| Isopropanol | 3–5 |
| Aliphatic Polyamonoamide | 40–44 |
| BOILING POINT: 181 F. | |
| VAPOR PRESSURE (mm Hg): 19.4. | |
| VAPOR DENSITY (AIR = 1): >1. | |
| SPECIFIC GRAVITY (H2O = 1): .94. | |
| PERCENT VOLATILE BY VOLUME (%): 57–61. | |
| EVAPORATION RATE (BuAc = 1): 1.72. | |
| SOLUBILITY IN WATER: Negligible, less than 0.1 percent. | |
| APPEARANCE AND ODOR: Water clear liquid, solvent odor. | |

The epoxy is sprayed using standard paint application equipment and fixtures. The sprayed parts are dried in a position, which will not promote drips and runs. The epoxy is air dried. Once the first coat is dry should any runs or drips occur they are removed with abrasive paper and alcohol wiped and a second coat of Humiseal # 2A53 is applied.

Another very useful moisture resistant coating is sold under the tradename Siloxirane™. Siloxirane™ comprises Pentaglycidalether of Cyclosilicon, a cross-linked organic-inorganic multifunctional polymer coating, that is cured trough homopolimerization. Siloxirane™ has specifications of Volume Solids: 88.6%, VOC: 0.9 lbs/gal (108 g/L).

Figure 3:
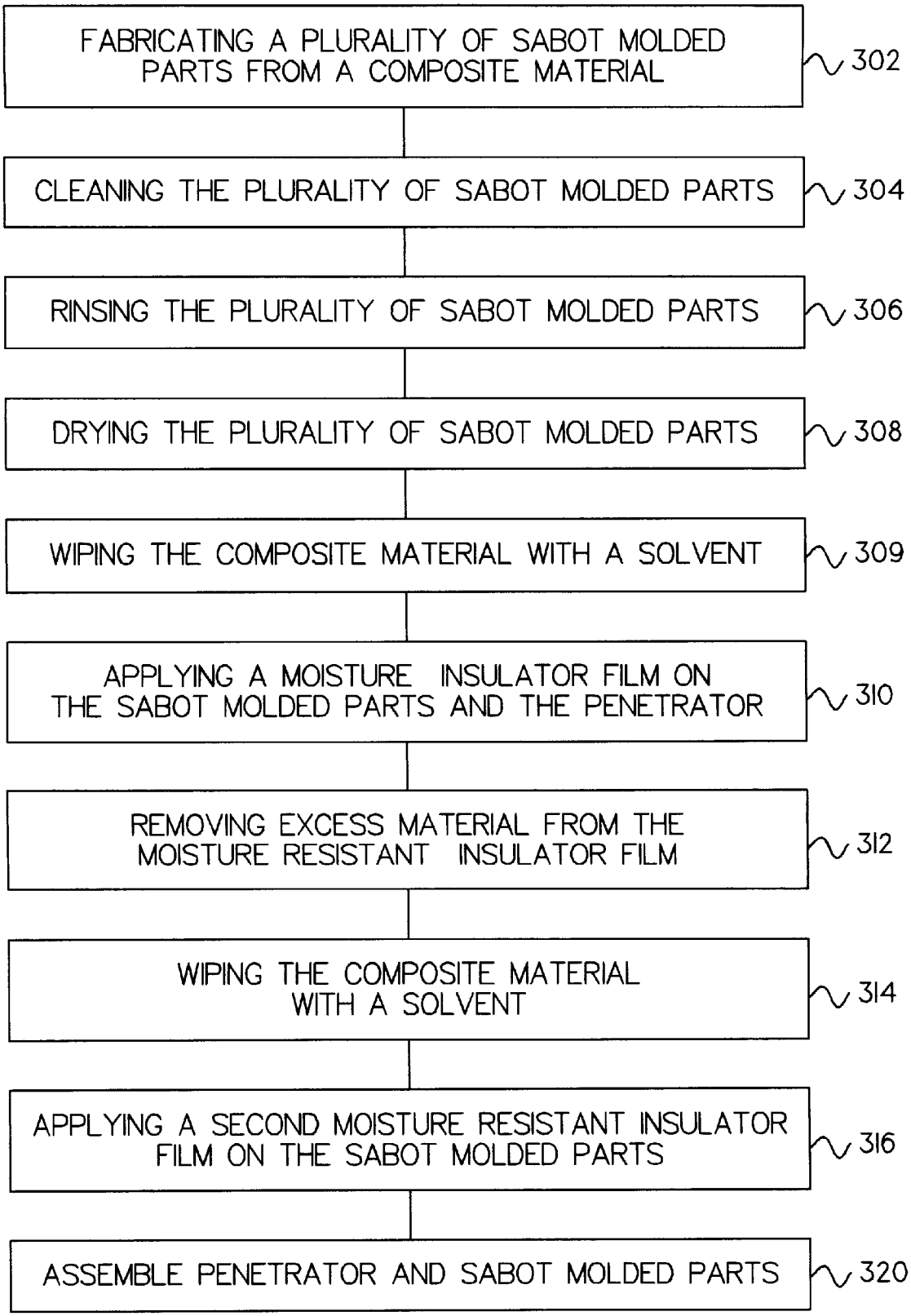
FIG. 3 shows a flow chart of one example of a method for fabricating a composite sabot including a depleted uranium penetrator.

Now referring to FIG. 3, a flow chart of one example of a method for fabricating a composite sabot assembly including a depleted uranium penetrator is shown. The method begins with the step of fabricating a plurality of sabot molded parts from a composite material sabot parts, step 302. Fabrication of sabot molded parts is well known. After the molded parts are fabricated, including all necessary machining, the plurality of sabot molded parts are cleaned, step 304. As above, the cleaned parts are processed by the steps of rinsing the plurality of sabot molded parts, step 306, drying the plurality of sabot molded parts, step 308 and wiping the plurality of sabot molded parts with a solvent, step 309.

The parts are now ready for applying and curing a moisture resistant insulator film on the plurality of sabot molded parts, step 310. In one example, the plurality of sabot molded parts and the penetrator is assembled in a conventional manner before the film is applied at step 310.

In an alternate embodiment, the moisture resistant insulator film is also applied to the penetrator before the assembling step 320. In addition, as indicated in FIG. 2, multiple applications of the moisture resistant insulator film may advantageously be applied to the component parts before final assembly at step 320. Similarly, excess material may advantageously be removed from the coated component parts between coats as indicated by step 312. After removing the excess material, the composite wiped with a solvent at step 314. In a more preferred embodiment, a second coat of moisture resistant insulator film is applied to the parts at step 316 and then cured in accordance with the film manufacturer's specifications. The coating steps may be repeated as desired for multiple coats before final assembly at step 320.

Following the method of the invention as detailed, for example in FIG. 3, provides a corrosion resistant composite sabot assembly including a depleted uranium penetrator as shown in FIG. 1. The composite sabot assembly includes a plurality of sabot molded parts wherein the plurality of sabot molded parts have a coating of a moisture resistant insulator film. The plurality of sabot molded parts are assembled together to hold the depleted uranium penetrator, where the moisture resistant insulator film forms a barrier between the depleted uranium penetrator and the sabot molded parts.

The corrosion resistant composite sabot assembly can be fabricated from composite material sabot parts including carbon, glass, graphite, a continuous fiber/epoxy system, a chopped fiber/epoxy system, a thermoset fiber/epoxy system, a thermoplastic fiber/epoxy system, a continuous thermoset fiber/epoxy system, a chopped thermoset fiber/epoxy system, a continuous thermoplastic fiber/epoxy system, a chopped thermoplastic fiber/epoxy system, a thermoset fiber/resin system, a thermoplastic fiber/resin system, a continuous thermoset fiber/resin system, a chopped thermoset fiber/resin system, a continuous thermoplastic fiber/resin system, and a chopped thermoplastic fiber/resin system or equivalent materials. The corrosion resistant composite sabot assembly components can be coated with a moisture resistant insulator film material such as acrylic, urethane, polyurethane, epoxy paint or two-part epoxy synthetic resins.

The invention has been described herein in considerable detail in order to comply with the Patent Statutes and to provide those skilled in the art with the information needed to apply the novel principles of the present invention, and to construct and use such exemplary and specialized components as are required. However, it is to be understood that the invention may be carried out by specifically different equipment and devices, and that various modifications, both as to the equipment details and operating procedures, may be accomplished without departing from the true spirit and scope of the present invention.

What is claimed is:

1. A method for coating composite material sabot parts for reducing depleted uranium corrosion and sealing the surface of the composite material sabot parts, the method comprising the steps of:

a) cleaning the composite material sabot parts;

b) rinsing the composite material sabot parts;

c) drying the composite material sabot parts;

d) wiping the composite material sabot parts with a solvent;

e) applying a moisture resistant insulator film on the composite material sabot parts, wherein the moisture resistant insulator film comprises a two-part epoxy material, wherein a first part consists essentially of from 18–21% by weight of Toluene, from 12–15% by weight of Methyl Isobutyl Ketone, and from 60–70% of epoxy resin, and wherein a second part consists essentially of from 40–43% Xylene by weight, from 3–5% of Ethyl Benzene by weight, from 8–11% of Butyl Alcohol by weight, from 3–5% Isopropanol by weight and from 40–44% Aliphatic Polyamonoamide by weight; and f) curing the moisture resistant insulator film.

2. The method of claim 1 wherein the step of drying comprises air drying.

3. The method of claim 2 further comprising the steps of removing excess material from the moisture resistant insulator film.

4. The method of claim 3 wherein the step of removing excess material comprises the steps of:

a) removing excess material with abrasive paper;

b) wiping the composite material sabot parts with a solvent;

c) applying at least one additional coat of moisture resistant insulator film; and d) curing the moisture resistant insulator film.

5. The method of claim 1 wherein the step of cleaning comprises cleaning the composite material sabot parts in a heated ultrasonic washer.

6. A method for fabricating a composite sabot including a depleted uranium penetrator, the method comprising the steps of:

a) fabricating a plurality of sabot molded parts from a composite material;

b) cleaning the plurality of sabot molded parts;

c) rinsing the plurality of sabot molded parts;

d) drying the plurality of sabot molded parts;

e) wiping the plurality of sabot molded parts with a solvent;

g) applying a moisture resistant insulator film on the plurality of sabot molded parts, wherein the moisture resistant insulator film comprises a two-part epoxy material, wherein a first part consists essentially of from 18–21% by weight of Toluene, from 12–15% by weight of Methyl Isobutyl Ketone, and from 60–70% of epoxy resin, and wherein a second part consists essentially of from 40–43% Xylene by weight, from 3–5% of Ethyl Benzene by weight, from 8–11% of Butyl Alcohol by weight, from 3–5% Isopropanol by weight and from 40–44% Aliphatic Polyamonoamide by weight;

f) curing the moisture resistant insulator film; and g) assembling the plurality of sabot molded parts and the penetrator.

7. The method of claim 6 further comprising the step of applying a moisture resistant insulator film to the penetrator before the assembling step.

8. The method of claim 7 wherein the step of drying comprises air drying.

9. The method of claim 8 further comprising the steps of removing excess material from the moisture resistant insulator film.

10. The method of claim 9 wherein the step of removing excess material comprises the steps of:

a) removing excess material with abrasive paper;

b) wiping the composite material sabot parts with a solvent; and c) applying at least one additional coat of moisture resistant insulator film.

* * * * *